US011717118B2

(12) United States Patent
Green et al.

(10) Patent No.: US 11,717,118 B2
(45) Date of Patent: Aug. 8, 2023

(54) DISPENSING DEVICE WITH MOUNTING BRACKET

(71) Applicant: Kimberly-Clark Worldwide, Inc., Neenah, WI (US)

(72) Inventors: Jonathan Green, Wrexham (GB); Klemen Erzen, Preddvor (SI)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 17/679,462

(22) Filed: Feb. 24, 2022

(65) Prior Publication Data

US 2022/0175198 A1 Jun. 9, 2022

Related U.S. Application Data

(63) Continuation of application No. 17/263,949, filed as application No. PCT/US2020/039609 on Jun. 25, 2020, now Pat. No. 11,278,164.

(51) Int. Cl.
*A47K 10/10* (2006.01)
*A47K 5/12* (2006.01)
(Continued)

(52) U.S. Cl.
CPC ..... *A47K 10/10* (2013.01); *A47K 5/12* (2013.01); *A47K 10/34* (2013.01); *A47K 2010/3233* (2013.01); *A47K 2201/02* (2013.01)

(58) Field of Classification Search
CPC ..... A47K 10/10; A47K 5/12; A47K 10/34; A47K 2010/3233; A47K 2201/02
(Continued)

(56) References Cited

U.S. PATENT DOCUMENTS 1,693,338 A * 11/1928 Honschopp ..... A47K 10/38 225/41
2,121,346 A * 6/1938 Harvey ..... A47K 10/36 225/46
(Continued)

FOREIGN PATENT DOCUMENTS

CA 2839615 7/2015
EP 0175350 3/1986
(Continued)

OTHER PUBLICATIONS

International Search Report and Written Opinion for PCT/US2020/039609 dated May 10, 2020, 7 pages.

*Primary Examiner* — Stephen M Gravini
(74) *Attorney, Agent, or Firm* — Dority & Manning, P.A.

(57) ABSTRACT

A dispenser for dispensing materials is disclosed. The dispenser includes a backplate, a cover, and a circular mounting bracket. The backplate includes a second side having a bracket engagement area thereon. The cover encloses at least portion of the backplate when in a closed condition forming a housing having an interior volume so as to retain at least one dispensable product. The circular mounting bracket includes a faceplate containing one or more holes configured to receive a fastener for securing the mounting bracket to a wall. The faceplate includes at least one flange raised from a first surface of the faceplate. The bracket engagement area includes at least one latching means configured to engage the flange to secure the backplate to the mounting bracket.

20 Claims, 12 Drawing Sheets

(51) Int. Cl.
*A47K 10/34* (2006.01)
*A47K 10/32* (2006.01)

(58) Field of Classification Search
USPC ..... 222/181.2, 181
See application file for complete search history.

(56) References Cited

U.S. PATENT DOCUMENTS 3,494,518 A * 2/1970 Goss ..... A47K 10/38 225/34
4,122,738 A * 10/1978 Granger ..... A47K 10/3643 83/191
4,552,315 A 11/1985 Granger
4,732,306 A 3/1988 Jesperson
5,630,526 A 5/1997 Moody
5,772,291 A 6/1998 Byrd et al.
5,836,862 A 11/1998 Granger
5,868,343 A 2/1999 Granger
5,924,617 A * 7/1999 LaCount ..... A47K 10/36 242/564.2
5,979,284 A * 11/1999 Granger ..... A47K 10/3643 74/32
6,027,002 A 2/2000 Granger
6,591,727 B1 7/2003 Purcell et al.
7,059,493 B2 6/2006 Welchel et al.
7,841,556 B2 11/2010 Elliott et al.
8,955,790 B2 2/2015 Jokitalo et al.
9,682,390 B2 6/2017 Ophardt et al.
10,202,232 B2 2/2019 Wegelin et al.
11,278,164 B2 * 3/2022 Green ..... A47K 10/34
2003/0106398 A1 6/2003 Tramontina et al.
2011/0024585 A1 2/2011 Brinkdopke et al.
2015/0190827 A1 7/2015 Ophardt et al.
2022/0175198 A1 * 6/2022 Green ..... A47K 10/34

FOREIGN PATENT DOCUMENTS

EP 2896340 7/2015
WO WO0249490 6/2002
WO WO-2021262177 A1 * 12/2021 ..... A47K 10/10

* cited by examiner

DISPENSING DEVICE WITH MOUNTING BRACKET

RELATED APPLICATION

The present application is a continuation application from U.S. patent application Ser. No. 17/263,949 filed on Jan. 28, 2021, which is the national stage entry of International Patent Application No. PCT/US2020/039609 having a filing date of Jun. 25, 2020, which are incorporated herein in their entirety by reference thereto.

BACKGROUND

Washrooms in commercial and residential buildings typically include products such as toilet tissue, paper towels, diapers, feminine products, liquid products such as soap, and aerosol products such as air fresheners. These products are typically housed by a dispenser and are dispensed as needed by the user. In commercial washrooms, there can be multiple product dispensers present in the washroom. Thus, initial installation of the product dispensers can be very time consuming and tedious, given the number of product dispenser present in one washroom. For commercial buildings having multiple washrooms on multiple floors, installation of all product dispensers can be costly and time consuming. Additionally, once installed, maintenance personnel roam the buildings in which they are working to service the washrooms, or the maintenance personnel are sent to service a particular washroom or dispenser after a problem has occurred. One such problem may involve the displacement of an installed product dispenser from the wall. Fixing dispensers in the washroom after installation can result in numerous tenant complaints and overall dissatisfaction. Additionally, maintenance personnel resources are focused on servicing emergencies and are pulled away from other tasks.

In view of the above, a need exists for a dispenser design that allows for more improved dispenser installation in a washroom facility.

SUMMARY

In general, the present disclosure is directed to a dispenser that can be more easily installed. In embodiments, the dispenser includes a backplate having one or more bracket mating areas capable of engaging a mounting bracket to secure the dispenser to a mounting surface.

In one embodiment, the dispenser includes a backplate having one or more bracket mating areas and a front cover enclosing at least a portion of the backplate when in a closed condition. The front cover and the backplate form a housing having an interior volume for retaining a dispensable product. The dispenser also includes a mounting bracket having a baseplate including a mounting surface and a dispenser facing surface. The mounting bracket has a top end and a bottom end. The top end includes a first ramp member having an angled ramp extension thereon and a second ramp member having an angled ramp extension thereon. The bottom end includes a third ramp member having a parallel ramp extension thereon and a fourth ramp member having a parallel ramp extension thereon. The angled ramp extensions and parallel ramp extensions are configured to frictionally engage the one or more bracket mating areas to secure the backplate of the dispenser to the mounting bracket when the dispenser is mounted in a first position or a second position that is different from the first position.

In embodiments, the first position may be a horizontal position and the second position may be a vertical position. In certain embodiments, there is a ramp surface angle $\alpha$ between the parallel ramp extension and the angled ramp extension. The ramp surface angle $\alpha$ is from about 20° to about 80°, such as about 45°.

In embodiments, each of the ramp members can include at least two parallel ramp extensions and at least two angled ramp extensions. Further, each ramp member can include a first parallel ramp extension for engaging a bracket mating area when the bracket is mounted in a horizontal position, a second parallel ramp extension for engaging a bracket mating area when the bracket is mounted in a vertical position, a first angled ramp extension for engaging a bracket mating area when the bracket is mounted in a horizontal position, and a second angled ramp extension for engaging a bracket mating area when the bracket is mounted in a vertical position.

In accordance with the present disclosure, the mounting bracket can include a mounting bracket locking component configured to engage a recess or slot on the second side of the dispenser to further secure the dispenser to the bracket.

In certain embodiments, the mounting bracket can further include at least one leveling device oriented generally parallel to a longitudinal axis of the mounting bracket. The mounting bracket can also include at least one leveling device oriented generally parallel to a transverse axis of the mounting bracket. The one or more leveling devices can assist with hanging the bracket in a level manner in either a horizontal or vertical position.

In other embodiments, the mounting bracket includes a circular mounting bracket having a faceplate containing one or more holes configured to receive a fastener for securing the mounting bracket to a wall. The faceplate further includes at least one flange raised from the first surface of the faceplate that extends outwardly along the periphery of the faceplate and engages a bracket engagement area on the backplate of the dispenser.

In embodiments, the dispenser includes a housing formed by the backplate and the cover having an interior cavity. The dispenser can include a dispensing mechanism contained within the housing for dispensing a dispensable product. The dispensable product can include a roll of sheet material, such as paper towels or bath tissue. The dispensable product may include a dispensable product that is a liquid. The interior volume of the housing has a volume so as to retain at least two rolls of sheet material.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
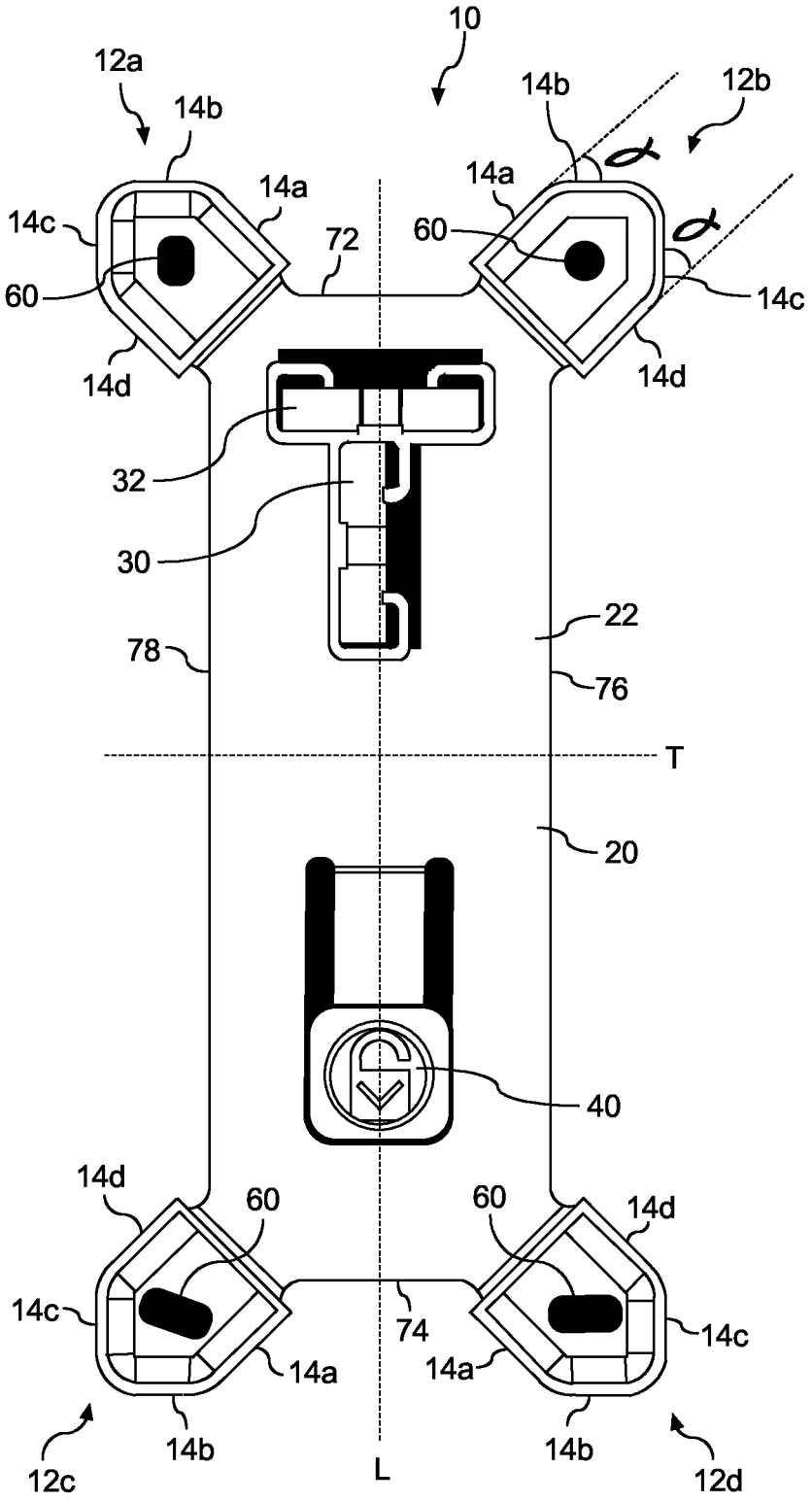
FIG. 1 is a plan view of one embodiment of a mounting bracket oriented in a vertical position in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

The present disclosure is generally directed to a dispenser for dispensable products, such as sheet materials, and/or to a dispenser assembly. The dispenser of the present disclosure allows for ease of installation and functionality of the dispenser. More particularly, the present disclosure is directed to a dispenser including a mounting bracket having one or more ramp members having one or more angled ramp extensions and one or more parallel ramp extensions thereon. The ramp extensions are capable of engaging the back plate of a dispenser and securing the dispenser to a mounting surface in multiple orientations. For example, the mounting bracket disclosed can be used to secure a dispenser to a mounting surface, such as a wall, in either a horizontal configuration or a vertical configuration. Indeed, such a mounting bracket and dispenser assembly allow for more accurate and rapid installation of dispensers in a washroom facilities and flexibility in design offerings and functionality without having to change the entire dispenser system. For instance, the mounting brackets disclosed herein can be used interchangeably with dispensers to easily mount the dispensers in multiple positions, such as in a horizontal position or a vertical position. Accordingly, the user can easily install multiple product dispensers in an efficient manner.

In one embodiment, the dispenser includes a backplate, a front cover, and a mounting bracket. The backplate is adapted to be mounted to a surface, such as a wall. The backplate includes a first side and a second opposite side. The second opposite side includes one or more bracket engagement areas. The front cover encloses at least a portion of said backplate when in a closed condition thus forming a housing having an interior volume so as to retain at least one dispensable product. The mounting bracket includes a bracket plate having one or more ramp members thereon. Each of the ramp members includes one or more parallel ramp extensions and one or more angled ramp extensions configured to engage the one or more bracket mating areas when the dispenser is mounted in a first position or a second position that is different from the first position.

Figure 2:
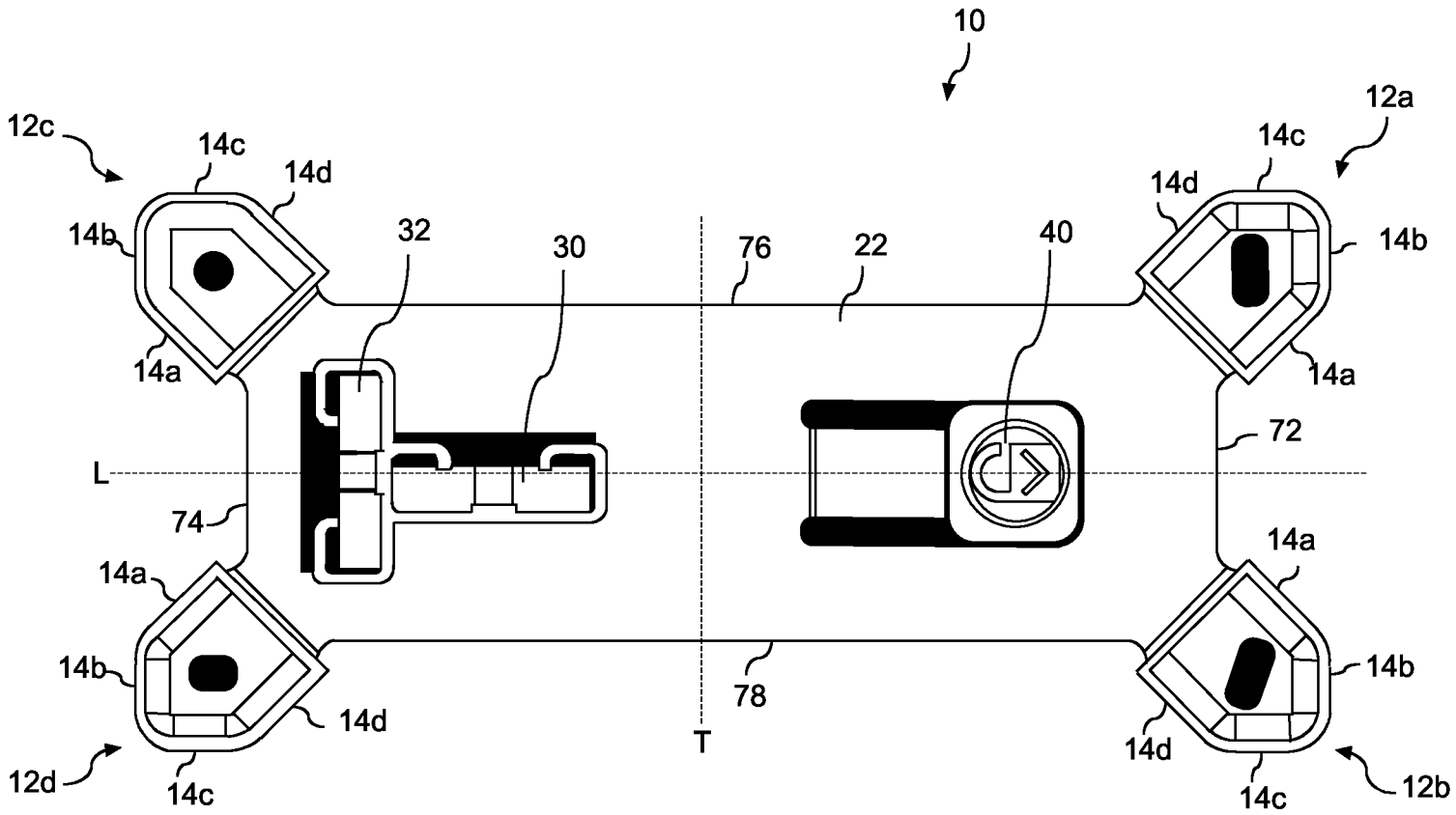
FIG. 2 is a plan view of one embodiment of a mounting bracket oriented in a horizontal position in accordance with the present disclosure.

Referring particularly to FIGS. 1-6 various embodiments of the mounting bracket 10 of the present disclosure are illustrated. FIG. 1 illustrates a mounting bracket 10 oriented in a vertical position, while FIG. 2 illustrates the same mounting bracket 10 oriented in a horizontal position. The mounting bracket 10 includes a baseplate 20 having a generally flat mounting surface 24 and a dispenser facing surface 22. The baseplate 20 can be any suitable shape for example, square, rectangular, ovular, circular, etc.

In embodiments, the baseplate 20 has a first transverse end 72, a second transverse end 74, and two laterally opposed longitudinal ends 76 and 78. Depending on the orientation of the bracket, any of the ends as shown and described can be the top end or bottom end of the bracket. For example, in certain vertical orientations, the first transverse end 72 may be the top end of the bracket with the second transverse end 74 being the bottom end of the bracket, while it is also feasible that the second transverse end 74 can be the top end of the bracket with the first transverse end 72 being the bottom end of the bracket. Similarly, in certain horizontal orientations, longitudinal end 76 can be the top end of the bracket and longitudinal end 78 can be the bottom end of the bracket, while it is also feasible that longitudinal end 78 can be the top end of the bracket and longitudinal end 76 can be the bottom end of the bracket.

In certain embodiments, the base plate 20 is rectangular having one or more ramp members generally located in each of the four corners of the baseplate 20. As shown, the mounting bracket 10 includes one or more ramp members 12*a*, 12*b*,12*c*,and 12*d* configured to the baseplate 20. The ramp members 12*a*, 12*b*, 12*c*, and 12*d* extend laterally from the baseplate 20. The ramp members 12*a*, 12*b*, 12*c*, and 12*d*, each comprise one or more ramp extensions 14. The ramp extensions 14 extend outward from the dispenser facing surface 22 of the baseplate 20. For example, when mounted, one or more ramp extensions 14 can project outward from the baseplate 20 such that they can engage one or more mating areas on the backplate 50 of the dispenser 100. In certain embodiments, the ramp member 12 can include one or more parallel ramp extensions. By "parallel" it is meant to refer to ramp extensions that are parallel with respect to each other. For example, as shown ramp extensions 14*a* and 14*d* are both parallel ramp extensions, given that they extend in parallel directions relative to each other. The ramp members 12 can also include one or more angled ramp extensions. By "angled" it is meant to refer to ramp extensions that are angled with respect to the one or more parallel ramp extensions. For example, as shown, ramp extensions 14*b* and 14*c* are angled ramp extensions. In such embodiments, ramp extensions 14*b* and 14*c* both extend in different directions from each other and also in different directions from parallel ramp extensions 14*a* and 14*d*. It should also be understood that the ramp extensions 14 can include a continuous ramp extension having one or more projection directions. For example, ramp extension 14 can include a continuous flange projecting from the dispenser facing surface 22 of the baseplate 20. Such a ramp extension 14, can include different ramp extensions 14*a*, 14*b*, 14*c*, and 14*d* that project in the different directions as described herein.

Ramp extension angles $\alpha$ are located between the parallel ramp extensions 14*a* or 14*d* and the angled ramp extensions 14*b* and 14*c*, as shown. Ramp extension angle $\alpha$ may be between about 20° to about 80°, such as between about 30° to about 60°, such as between about 35° to about 50°, such as about 45°. In embodiments, the ramp extension angles α are configured such that at least two of the parallel ramp extensions and at least two of the angled ramp extensions are capable of engaging the backplate 50 of a dispenser when the dispenser 100 is mounted to a mounting surface with the mounting bracket. For example, ramp extension angle α is configured such that at least two of the angled ramp extensions can engage the dispenser in either a horizontal or vertical orientation, as discussed further herein.

The ramp extensions 14 are configured such that at least one of the ramp extensions 14 of each of the ramp members 12 can engage one or more bracket mating areas 52 on the backplate 50. For example, when the dispenser 100 is mounted to the mounting bracket 10 in a vertical position, angled ramp extensions 14*b* mate with the bracket mating areas 52 on the dispenser 10 along the top end of the bracket 10, while parallel ramp extensions 14*d* mate with the bracket mating areas 52 along the bottom end of the bracket 10. More specifically, angled ramp extension 14*b* of ramp member 12*a*, angled ramp extension 14*b* of ramp member 12*b*, parallel ramp extension 14*d* of ramp member 12*c*, and parallel ramp extension 14*d* of ramp member 12*d* each engage one or more bracket mating areas 52 of the backplate 50 of the dispenser 100. In the event that the bracket 10 is rotated 180° such that the second transverse end 74 is located above or on top of the first transverse end 72, the same configuration of parallel and angled ramp members can engage the mating areas on the backplate 50 of the dispenser 100. For example, where transverse end 74 is on top, angled ramp extension 14*b* of ramp member 12*d*, angled ramp extension 14*b* of ramp member 12*c*, parallel ramp extension 14*d* of ramp member 12*b*, and parallel ramp extension 14*d* of ramp member 12*a* each engage one or more bracket mating areas 52 on the backplate 50 of the dispenser. Accordingly, when in vertical configuration, angled ramp extensions 14*b* at the top end of the bracket 10 engage the bracket mating areas 52, whereas parallel ramp extensions 14*d* at the bottom end of the bracket 10 engage the bracket mating areas 52.

Referring now to FIG. 2, the mounting bracket 10 is shown in a horizontal orientation. Similar to FIG. 1, the baseplate has a first transverse end 72, a second transverse end 74, and two laterally opposed longitudinal ends 76 and 78. When the dispenser 100 is mounted to the mounting bracket 10 in a horizontal position, angled ramp extensions 14*c* mate with the bracket mating areas 52 on the dispenser 10 along the top end of the bracket 10, while parallel ramp extensions 14*a* mate with the bracket mating areas 52 along the bottom end of the bracket 10. More specifically, angled ramp extension 14*c* of ramp member 12*c*, angled ramp extension 14*c* of ramp member 12*a*, parallel ramp extension 14*a* of ramp member 12*d*, and parallel ramp extension 14*a* of ramp member 12*b* each engage one or more bracket mating areas 52 of the backplate 20 of the dispenser 100. In the event that the bracket 10 is rotated 180° such that longitudinal end 78 is located above or on top of longitudinal end 76, the same configuration of parallel and angled ramp members can engage the mating areas 52 on the backplate 50 of the dispenser 100. For example, when longitudinal end 78 is on top, angled ramp extension 14*c* of ramp member 12*b*, angled ramp extension 14*c* of ramp member 12*d*, parallel ramp extension 14*a* of ramp member 12*c*, and parallel ramp extension 14*a* of ramp member 12*a* each engage one or more bracket mating areas 52 on the backplate 50 of the dispenser. Accordingly, when in horizontal configuration, angled ramp extensions 14*c* at the top end of the bracket 10 engage the bracket mating areas 52, whereas parallel ramp extensions 14*a* at the bottom end of the bracket 10 engage the bracket mating areas 52.

Figure 3:
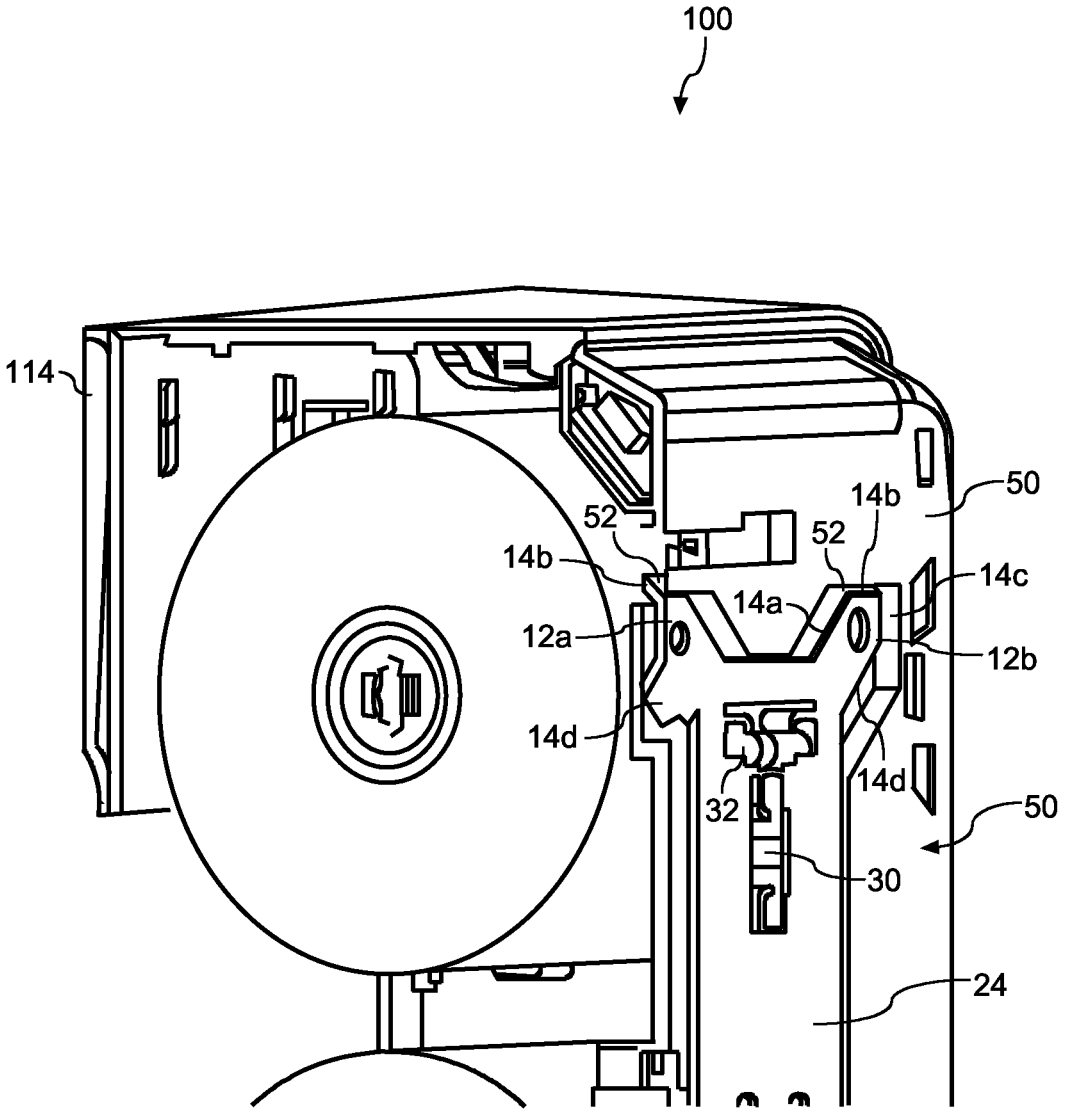
FIG. 3 is a perspective view of a dispenser mounted in a vertical position in accordance with the present disclosure.
Figure 4:
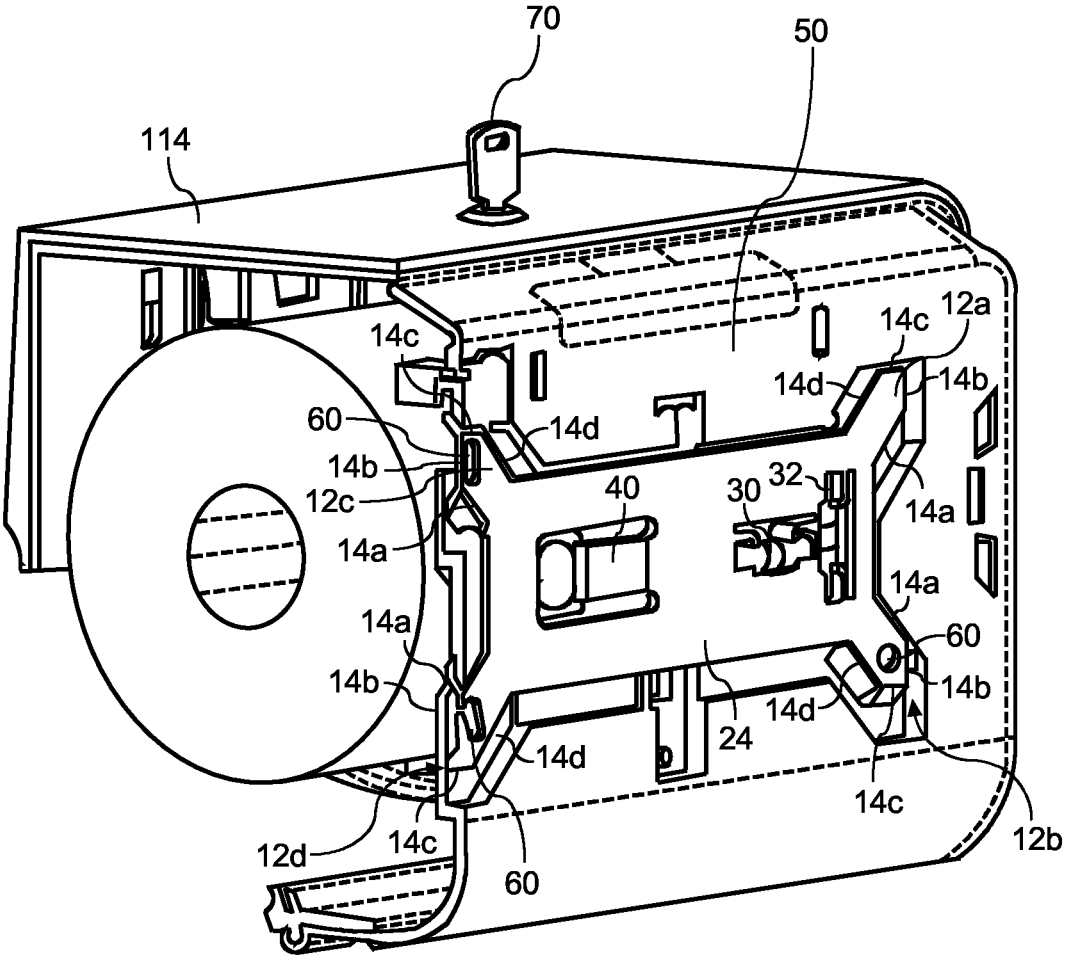
FIG. 4 is a perspective view of a dispenser mounted in a horizontal position in accordance with the present disclosure.
Figure 5:
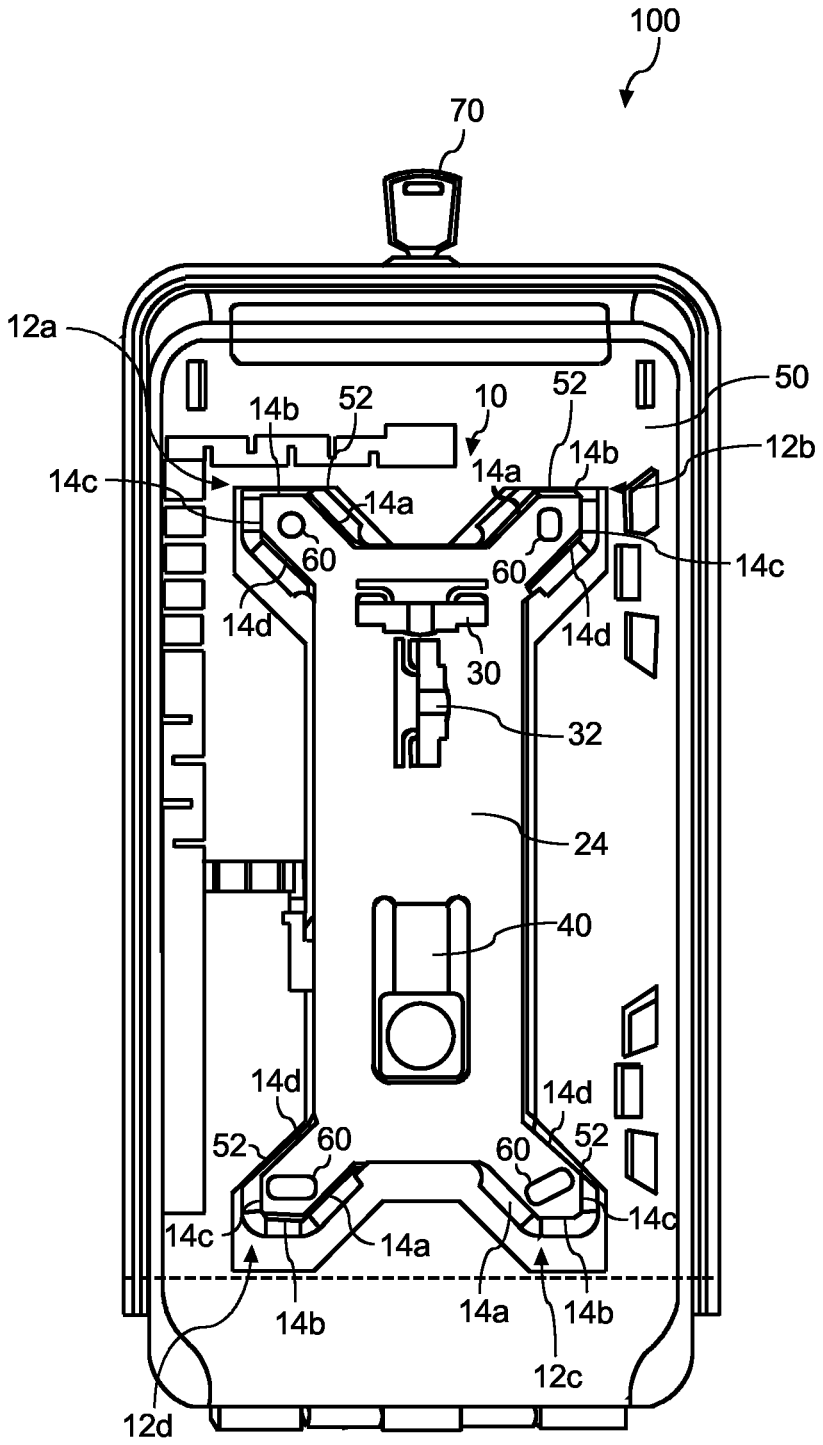
FIG. 5 is a rear plan view of a dispenser mounted in a vertical position in accordance with the present disclosure.
Figure 6:
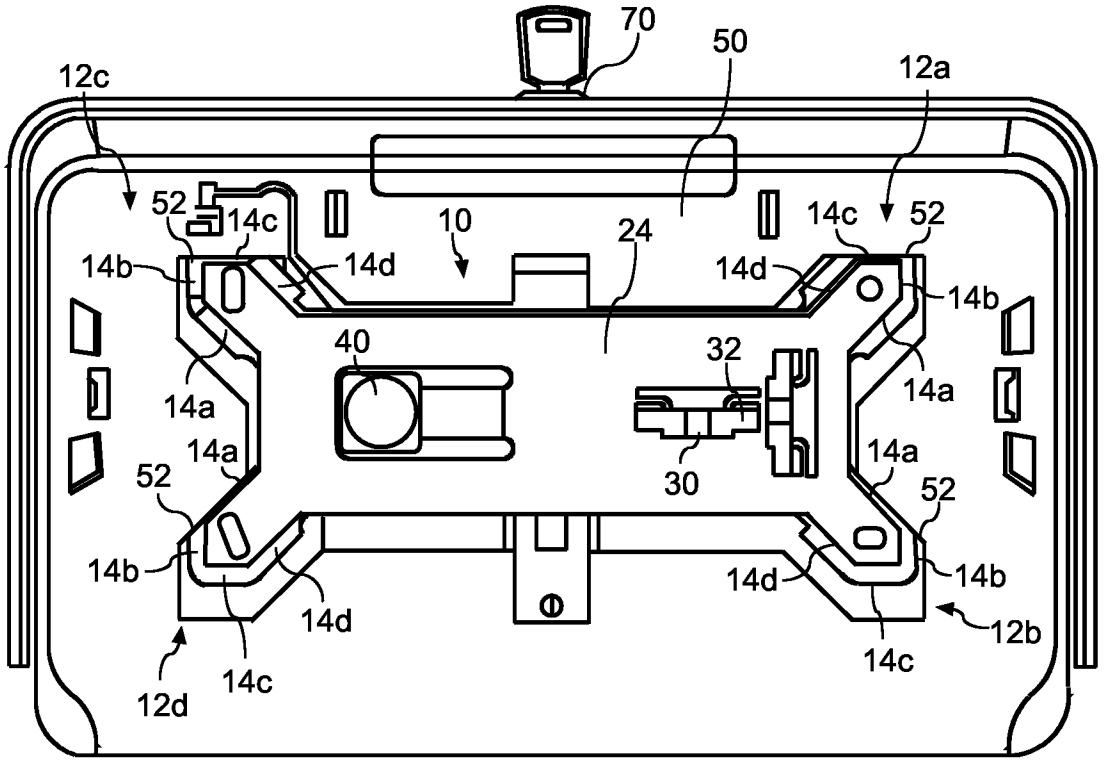
FIG. 6 is a rear plan view of a dispenser mounted in a horizontal position in accordance with the present disclosure.

FIGS. 3-6 illustrate various embodiments of the bracket 10 mounted to the backplate 50 of a dispenser 100 in a vertical manner. For example, FIG. 3 illustrates a dispenser 100 and bracket 10 mounted in a vertical position. Angled ramp extensions 14*b* of ramp members 12*a* and 12*b* engage the bracket mating areas 52 on the backplate 50 of the dispenser 100 in order to secure the dispenser 100 to a mounting surface. Parallel ramp extensions 14*d* of ramp members 12*d* and 12*c* engage corresponding bracket mating areas 52 on the backplate 50 of the dispenser 100. As shown in FIGS. 4 and 6, the dispenser 100 can be mounted in a horizontal position. When mounted in a horizontal position, angled ramp extensions 14*c* of ramp members 12*c* and 12*a* engage corresponding bracket mating areas 52, while parallel ramp extensions 14*a* of ramp members 12*d* and 12*b* engage corresponding bracket mating areas 52.

In certain embodiments, one or more of the ramp extensions 14 of each of the ramp members 12 may frictionally engage one or more bracket mating surfaces 52 on the backplate 50 of the dispenser 100. The bracket mating areas 52 can include slots or apertures configured to frictionally engage one or more ramp extensions 14 for securing the backplate 50 of the dispenser 100 to the mounting bracket 10. For example, in embodiments the backplate 50 of the dispenser 100 can include one or more apertures corresponding generally to the same size and shape of the respective ramp extensions 14 such that the desired ramp extensions 14 can engage and fit within the aperture to secure the mounting bracket 10 to the backplate 50 of the dispenser 100. The ramp extensions 14 are configured to frictionally engage the bracket mating areas 52 to prevent relative movement of the dispenser 100 with regard to the mounting bracket 10. It is to be understood that the bracket mating areas 52 can include other locking or latching members suitable for holding the ramp extensions 14 in place when they are engaged with the bracket mating areas 52. Further, the bracket mating areas 52 can be configured such that the desired ramp extensions 14 can snap fit within the bracket mating areas 52.

The mounting bracket 10 can further include a mounting bracket locking component 40 that is adapted to frictionally engage the dispenser 100. The mounting bracket locking component 40 further prevents relative movement of the dispenser 100 with respect to the mounting bracket 10. The mounting bracket locking component 40 may be in a latch-catch relationship with the dispenser 100 to provide frictional engagement. For example, the mounting bracket locking component 40 can include a flexible tab extending outward from the dispenser facing surface 22 towards the backplate 50 of the dispenser 100 to frictionally engage an aperture on the backplate 50 of the dispenser 100. For example, the flexible tab can snap-fit into place with a suitable slot or opening on the backplate 50 of the dispenser 100. In such embodiments, the flexible tab can also be depressed to allow for unlocking of the mounting bracket 10 from the dispenser 100. The mounting bracket locking component 40 can also stabilize the mounting bracket 10 to the dispenser 100.

In embodiments, the mounting bracket 10 can include one or more leveling devices. For example, in certain embodiments the mounting bracket 10 can include a leveling device 30 generally configured about a longitudinal axis (L) of the mounting bracket 10 for facilitating leveling of the bracket 10 along the longitudinal axis. In certain embodiments, the mounting bracket 10 can include a leveling device 32 generally configured about a transverse axis (T) of the mounting bracket 10 for facilitating leveling of the bracket 10 along the transverse axis. The leveling device 30 or 32 can be any optical instrument used to verify points in the axis such that the bracket 10 can be leveled. Advantageously, incorporation of both leveling device 30 and leveling device 32 allows for the bracket 10 to be installed in a horizontal or vertical orientation without requiring additional devices for leveling the mounting bracket 10 or the dispenser 100.

The mounting bracket 10 can include one or more apertures 60 configured to engage one or more fasteners such that the mounting bracket 10 can be secured to a mounting surface, such as a wall. One or more fasteners can be used to secure the mounting bracket 10 to the mounting surface. The fastener can include any hardware device that mechanically joins or affixes two or more objects together. The fastener(s) can be used to join the mounting bracket 10 to a mounting surface. The fastener(s) can include those that are able to create non-permanent joints, that is, the joint can be removed or dismantled without damaging the joined components. Thus, the fastener(s) selected can be used to removably join the mounting bracket 10 to the mounting surface. Any suitable fastener can be used. Suitable fasteners include, but are not limited to, anchors, bolts, nails, nuts, pins, clips, rivets, rods, screws, clamps, washers, and combinations thereof. In one embodiment, the fastener(s) includes a screw.

The dispenser 100 includes a backplate 50 and a front cover 114. The front cover 114 is configured such that when in a closed position (as shown), the front cover 114 encloses at least a portion of said backplate 50 forming a housing having an interior volume so as to retain at least one dispensable product. The interior volume of the housing can be configured to contain the operational components of the dispenser and the dispensable product. The housing can also be configured to include an opening through which a dispensable product is dispensed. In certain embodiments, the dispenser can include a roll of sheet material, such as a roll of paper towels or toilet tissue to be dispensed.

The backplate 50 can also include one or more walls extending laterally from the backplate 50. The backplate 50 can form at least a portion of the top wall, a portion of the side walls or a portion of the bottom of the dispenser. Further, when in a closed position, the front cover 114 can form at least a portion of the top wall, sidewalls, and/or the bottom wall of the dispenser 100.

The dispenser 100 can also include any conventional locking mechanism 40 for securing the front cover 114 to the backplate 50. For example, the locking mechanism 40 can include a key-hole to permit the locking mechanism 40 to be locked. Any latch and/or locking mechanism may be used to lock the front cover 114 to the backplate 50 in order to prevent tampering of the internal components of the dispenser 100.

Figure 7:
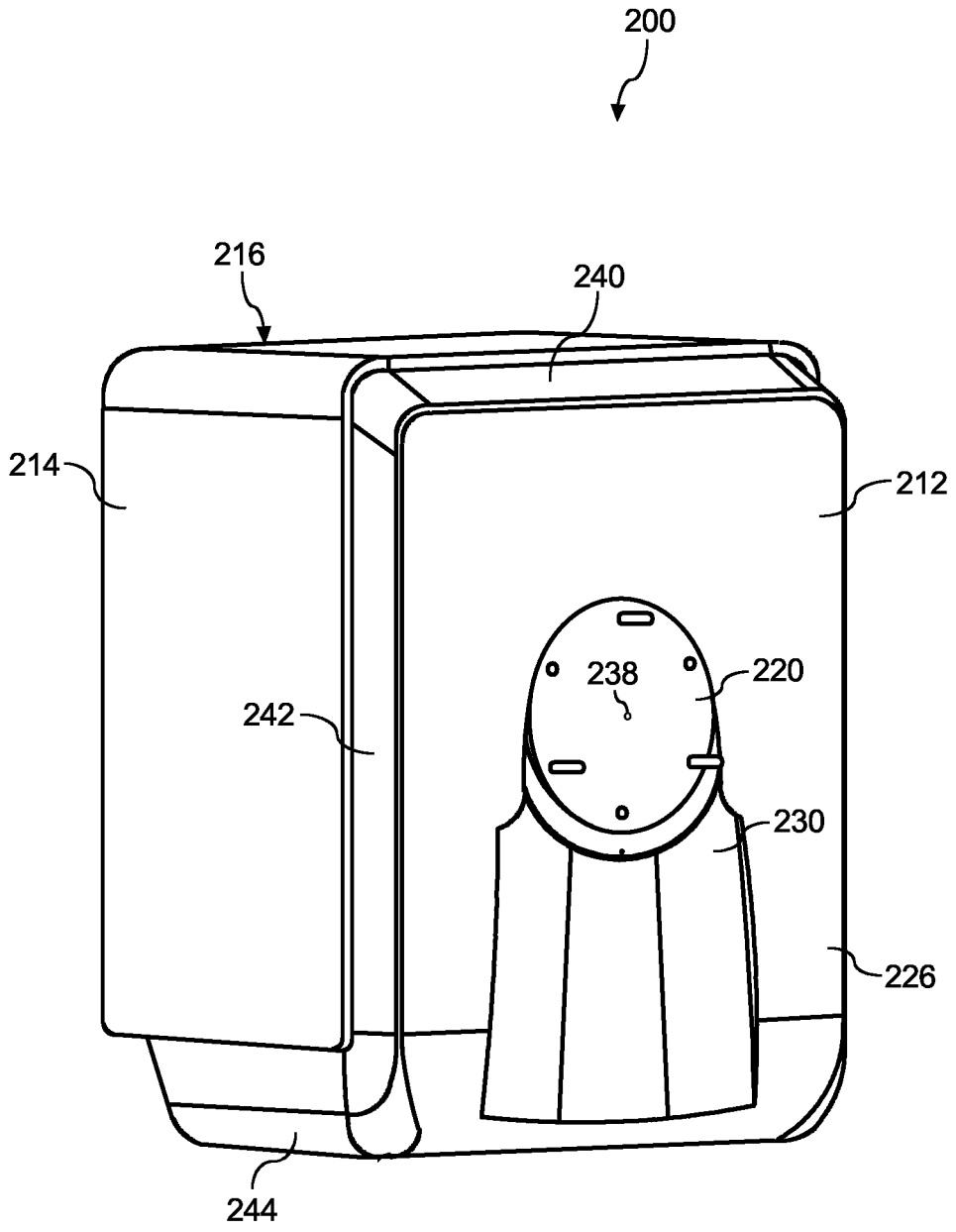
FIG. 7 is a perspective view of a dispenser in accordance with the present disclosure.

Referring now to FIGS. 7-12 various embodiments of dispenser 200 made according to the present disclosure are illustrated. As shown in FIG. 7, the dispenser 200 includes a backplate 212 and a cover 214. The cover 214 is configured such that when in a closed position (as shown), the cover 214 encloses at least a portion of said backplate 212 forming a housing having an interior volume so as to retain at least one dispensable product. The dispenser 200 includes a circular mounting bracket 220.

The backplate 212 can also include one or more walls extending laterally from the backplate 212. The backplate 212 can form at least a portion of the top wall 240 of the dispenser 200. The backplate 212 can also form at least a portion of the side walls 242 of the dispenser 200. Still, the backplate 212 can form at least a portion of the bottom wall 244 of the dispenser. As shown, when in closed position, the front cover 214 can form at least a portion of the top wall 240, sidewalls 242, and/or the bottom wall 244 of the dispenser 200.

The backplate 212 also includes a first side 224 and a second side 226, the second side 226 having a bracket engagement area 230 thereon. The bracket engagement area 30 can include any suitably shaped recess for engaging the mounting bracket 220. As shown, the bracket engagement area 230 can include a recess extending from the bottom of the backplate 212 up to the center of the backplate 212 of the dispenser 200. The bracket engagement area 230 can be conical in shape having a larger opening at the bottom of the backplate 212 that gradually tapers about the longitudinal axis of the backplate 212 to a rounded top. The bracket engagement area 230 can be configured in any shape such that the backplate 212 can slide over at least a portion of the mounting bracket 220 and securely engage the mounting bracket 220 thereby securing the backplate 212 of the dispenser 200 to a mounting surface, such as a wall.

In embodiments, the mounting bracket 220 is a circular mounting bracket. While in other embodiments, the mounting bracket 220 may be more ovular or elliptical in nature. The mounting bracket 220 includes a faceplate 222. The faceplate 222 has a first surface 225 and a second surface 227. The first surface 225 faces the dispenser 200 when the dispenser 200 is mounted to the mounting bracket 220. The second surface 227 faces the mounting surface, such as a wall surface, when the mounting bracket 220 is mounted to said surface. The first surface 225 includes at least one annular flange 228 extending laterally from the first surface 225 of the faceplate 222. The annular flange 228 extends annularly outward of the perimeter of the faceplate 222. The annular flange 228 has a first end 232 configured to the faceplate 222 of the mounting bracket 220 and a second end 234 extending from the first end 232 and away from the perimeter of the faceplate 222. In certain embodiments, the annular flange 228 can be integrally molded to the faceplate 222. In certain other embodiments, the annular flange 228 can be a separate part that is then attached to the first surface 224 of the faceplate 222 by any suitable manner. Attachment of the annular flange 228 to the faceplate 222 can be accomplished by any suitable adhesive process, including thermal bonding, melt adhesion, or by using a suitable adhesive to affix the annular flange 228 to the faceplate 222. As mentioned, in certain embodiments the annular flange 228 is integrally formed as part of the faceplate 222 during a molding process such as injection molding.

Figure 8:
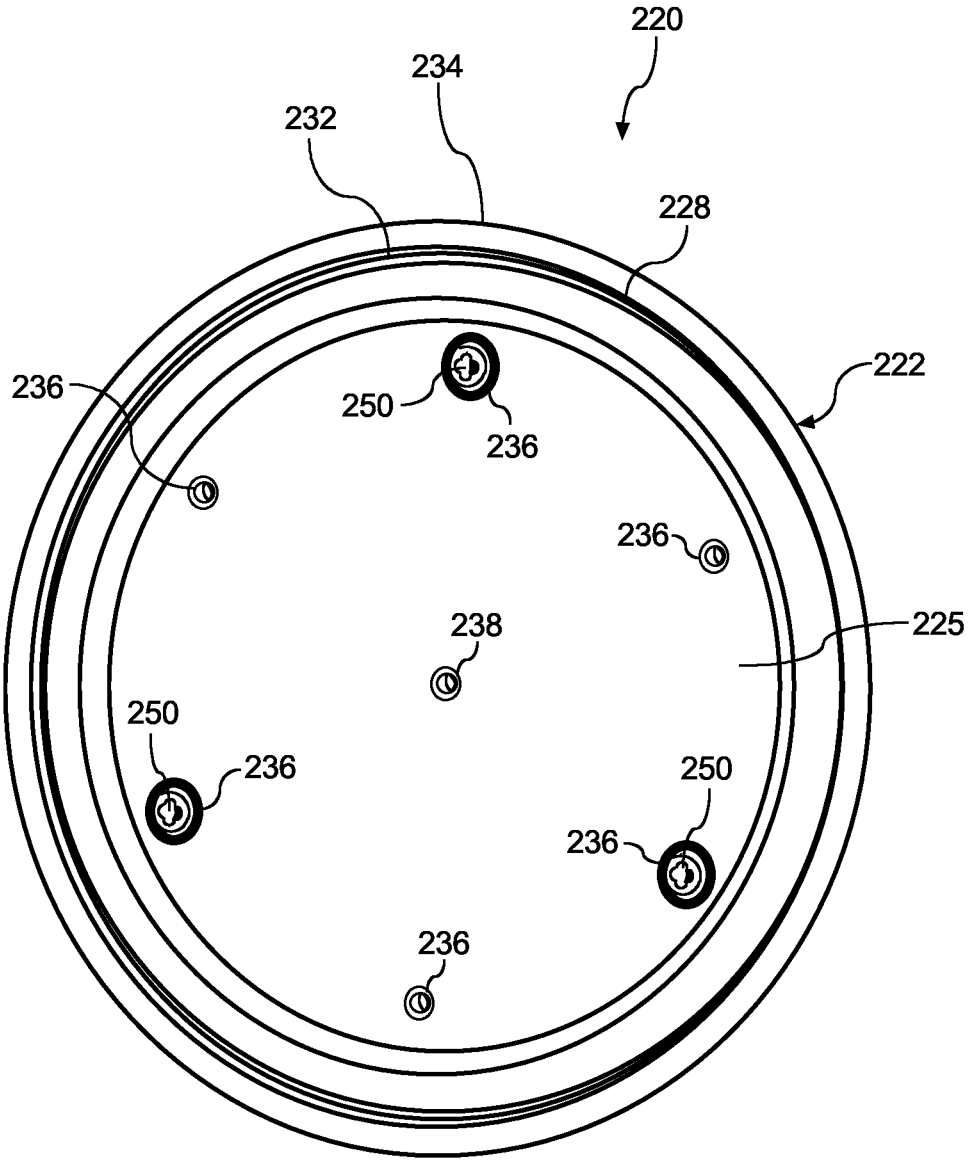
FIG. 8 is a plan view of a mounting bracket in accordance with the present disclosure.
Figure 9:
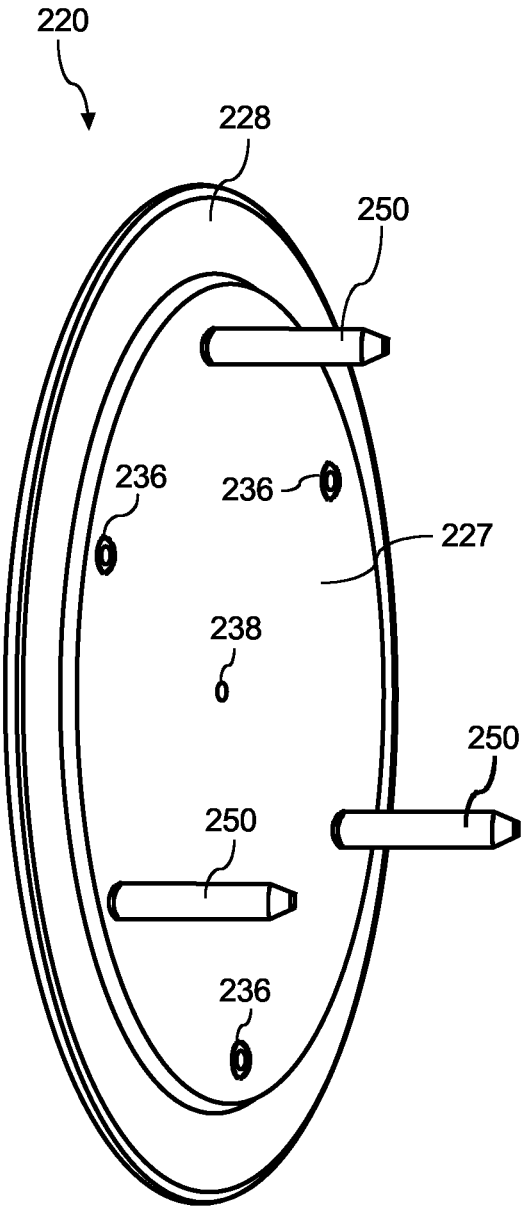
FIG. 9 is a perspective view of a mounting bracket in accordance with the present disclosure.

As shown in FIGS. 7-9, in certain embodiments, the faceplate 222 includes one or more holes 236 configured to receive a fastener 250 for securing the mounting bracket 220 to the mounting surface. The one or more holes 236 can be spatially configured in any suitable manner on the faceplate 222 to ensure a secure connection of the mounting bracket 220 to the mounting surface. For example, in certain embodiments, as shown in FIGS. 8-9, the one or more holes 236 include at least three holes spaced equidistance around the perimeter of the faceplate 222 of the mounting bracket 220. However, while a three-hole embodiment is shown, the disclosure is not so limited. In fact, any number of holes in any suitable pattern can be used on the faceplate 222 provided herein. For example, certain embodiments can include at least four holes, such as at least five holes, such as at least six holes, such as at least seven holes, such as at least eight holes. The holes 236 may be arranged in any type of pattern such as rectangular, square, elliptical, circular, etc. on the faceplate 222. In certain embodiments, the one or more holes 236 can be configured in an anti-ligature arrangement or pattern. For example, in an anti-ligature arrangement the holes are strategically placed on the faceplate 222 such that built-in breakable points are achieved. Thus, when the mounting bracket 220 is secured to a mounting surface utilizing the anti-ligature arranged holes, the bracket 220 will break loose from the mounting surface when a certain amount of force is exerted on the bracket 220. The force can be applied either directly to the bracket 220 itself or to the dispenser 200 mounted on the bracket 220. The anti-ligature holes may be utilized when the dispenser 200 is being mounted on a surface in an environment with a high suicide rate, such as medical facilities, prisons, detention centers, and mental health facilities. In these high suicide rate environments, various structures within a room of the facility may be used as an anchor point in suicide attempts. Thus, configuring the mounting bracket 220 to include an anti-ligature design allows for the dispenser disclosed herein to be utilized in high suicide rate environments, which may not be possible for other dispensers not having anti-ligature mounting capabilities.

In certain embodiments, the mounting bracket 220 also includes a center hole 238 for facilitating placement of the mounting bracket 220 to the mounting surface. The center hole 238 can be utilized to mark the placement of the bracket 220 and the dispenser 200 on the mounting surface, such as a wall. In other embodiments, the center hole 238 can be aligned with a previously marked spot, such that multiple mounting brackets 220 can be mounted in a uniform and level nature across a mounting surface.

Figure 10:
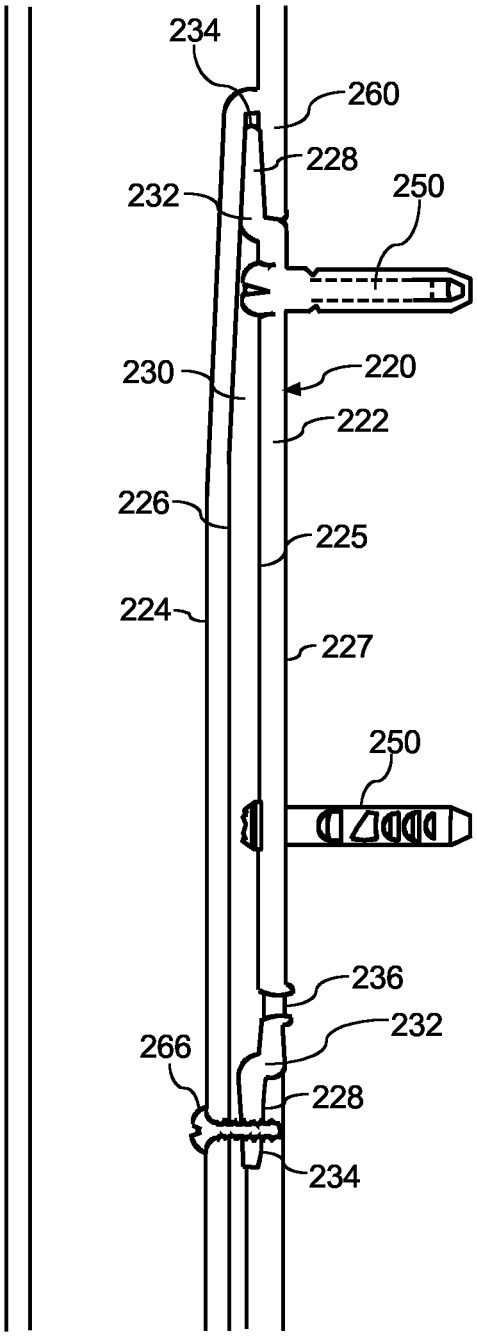
FIG. 10 is a cross section view of the dispenser and mounting bracket in accordance with the present disclosure.
Figure 11:
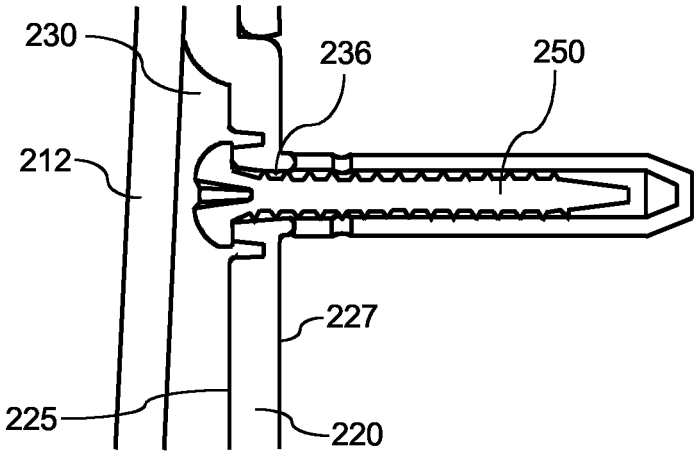
FIG. 11 is an exploded cross section view of the dispenser and mounting bracket in accordance with the present disclosure.
Figure 12:
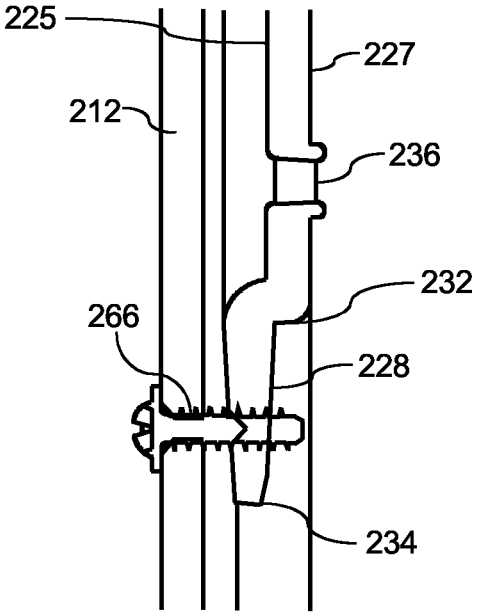
FIG. 12 is an exploded cross section view of the dispenser and mounting bracket in accordance with the present disclosure.

As shown in FIGS. 9-10, one or more fasteners 250 can be used to secure the mounting bracket 220 to a mounting surface 255, such as a wall. The fastener 250 can include any hardware device that mechanically joins affixes two or more objects together. The fastener(s) can be used to join the mounting bracket 220 to a mounting surface 255. The fastener(s) 250 can include those that are able to create non-permanent joints, that is, the joint can be removed or dismantled without damaging the joined components. Thus, the fastener(s) selected can be used to removably join the mounting bracket 220 to the mounting surface. Any suitable fastener can be used. Suitable fasteners include, but are not limited to, anchors, bolts, nails, nuts, pins, clips, rivets, rods, screws, clamps, washers, and combinations thereof. In one embodiment, the fastener(s) includes a screw.

Figure 13:
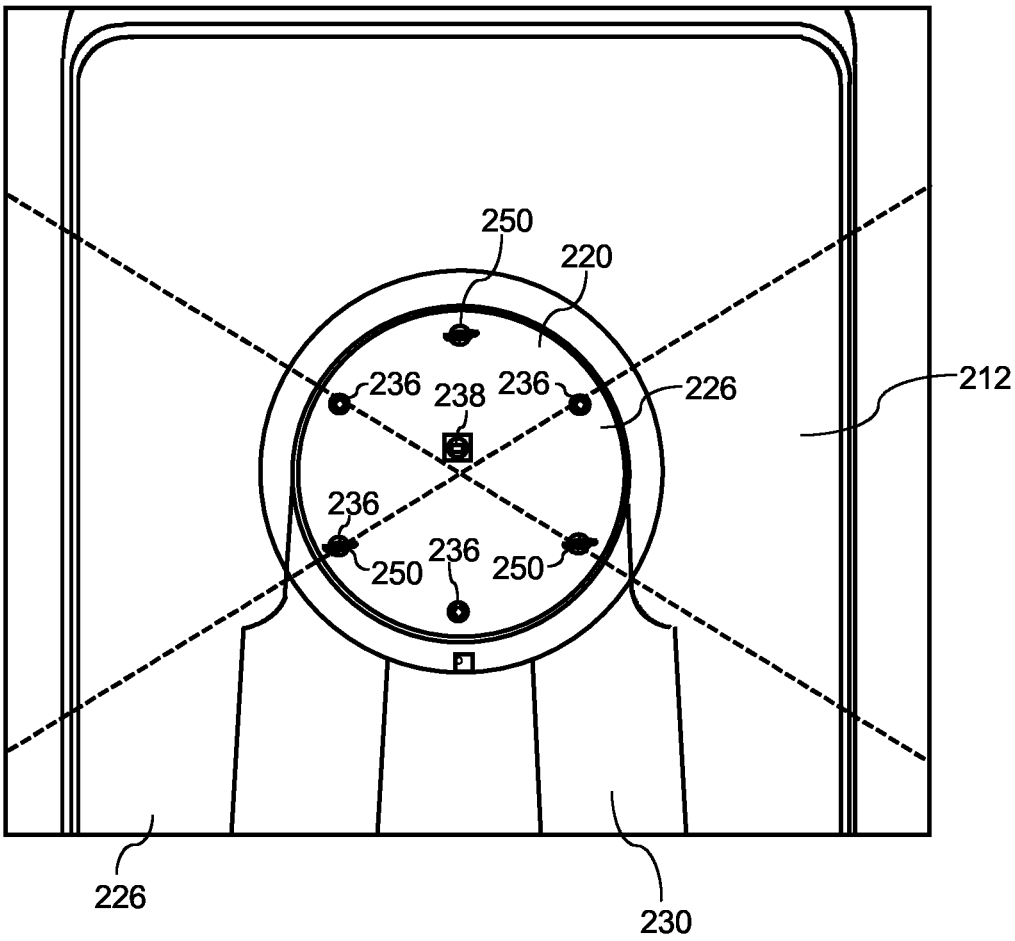
FIG. 13 is plan view of the rear of the dispenser in accordance with the present disclosure.

As shown in FIG. 10, the bracket engagement area 230 can include at least one latching means 260 configured to engage the flange 228 to secure the mounting bracket 220 to the mounting surface. In certain embodiments, the latching means 260 includes a recess for generally accepting and securing the flange 228 of the mounting bracket 220. In embodiments, where the latching means 260 includes a recess, the recess may generally be complementary in shape for accepting and securing the flange 228 of the mounting bracket 220. The latching means 260 can include a partial recess, such as a cavity, for receiving and interlocking with the flange 228 of the mounting bracket 220. The flange 228 is an annular flange corresponding to the 360° perimeter of the circular mounting bracket 220. Thus, in certain embodiments, when the flange 228 is engaged within the latching means 260 of the bracket engagement area 230, at least from about 220° to about 250° of the flange 228 is engaged with the latching means 260 when the backplate 212 is secured to the mounting bracket 220. (See FIG. 13). Securing at least about 220° to about 250° of the flange 228 with the latching means 260, ensures that the backplate 212 is securely mounted to the mounting bracket 220.

In certain embodiments, the backplate 212 includes a first side 224 that faces the interior of the dispenser and a second side 226 that faces the mounting surface when the backplate 212 is mounted to the mounting surface. The backplate 212 can include a fastener indicator 266. The fastener indicator 266 may be any mark such as a dot, x-mark, small hole, pin hole, small cavity, or combinations thereof. The fastener indicator 266 provide an indication of where to place a screw, such as a self-tapping screw, such that the backplate 212 can be further secured to the flange 228 of the mounting bracket 220. (See FIGS. 10-12). In these embodiments, the user can utilize the fastener indicators 266 on the first side 224 of the backplate 212 to further attach and secure the backplate 212 to the flange 228 of the mounting bracket 220. In certain embodiments, one or more fastener indicators 266 may be present.

The dispenser 200 includes a housing 216 that can have any desired overall shape. The housing 216 can include a two-part configuration. For example, the housing can include a backplate 212 and a front cover 214. The front cover 214 can be pivotally mounted to the backplate 212 using any suitable means. For example, in one embodiment, hinges can be used to connect the front cover 214 with the backplate 212. Alternatively, the front cover 214 can be completely separable from the backplate 212. The front cover 214 is moveable from a closed position to an open position. In embodiments, the front cover 214 defines the front face and at least a portion of the sidewalls 242 and the top wall 240. In certain embodiments, the backplate 212 forms at least a portion of the top wall 240, the sidewalls 242, and the bottom 244. In certain embodiments, the front cover 214 may have side walls that cooperate with the side walls of the backplate 212. The housing 216 defines an interior volume for housing the operational components of the dispenser 200, as well as the dispensable product. In certain embodiments, the dispensable product can be a roll or rolls of sheet material, including a main roll and a stub roll. The dispenser 200 can also include any conventional locking mechanism for securing the front cover 214 to the backplate 212. The housing 216 further includes an opening through which a dispensable product, such as a sheet material is dispensed.

The dispenser configurations illustrated in the figures are merely exemplary for any number of dispenser configurations known to those skilled in the art that may incorporate the mounting bracket embodiments of the present disclosure. As such, a detailed explanation of the structural and control features of the dispensers are not necessary for purposes of explanation of the system and method of the present disclosure.

The operational components of the dispensers disclosed herein may be mounted directly to the backplate or can be part of a module that is received within the housing. For example, the operational components can be part of a module that may be readily removable from the housing for servicing and/or replacing components without the necessity of having to remove the entire dispenser from its support surface.

Further provided herein are methods for mounting a dispenser to a mounting surface, such as a wall. The method includes placing a circular mounting bracket on a desired wall location. The mounting bracket can include a center hole designed to allow the user to correctly place the mounting bracket on a mark on the wall. The mounting bracket includes a faceplate including at least one flange raised from a first surface of the faceplate. The flange extends outward along the periphery of the faceplate. The circular mounting bracket can be secured to the wall with one or more fasteners. For example, in certain embodiments, the mounting bracket can include one or more holes on the faceplate configured to receive and engage a fastener for attaching the mounting bracket to a mounting surface. Suitable fasteners may include screws.

In certain embodiments, a dispenser indicator can be utilized and place on the mounting bracket to ensure correct placement of the mounting bracket on the wall. For example, in certain embodiments, the dispenser indicator can include a paperboard cutout corresponding to the dimensions of the backplate of the dispenser. In this manner, the dispenser indicator can be utilized to determine or ensure the appropriate location of the dispenser on a mounting surface, such as a wall.

The method also includes securing the backplate of the dispenser on the mounting bracket by sliding a second side of the backplate having a bracket engagement area thereon including at least one latching means over the flange to secure the backplate to the mounting bracket, such that from about 220° to about 250° of the flange engages the latching means when the backplate is secured to the mounting bracket.

Advantageously, utilizing the mounting brackets according to the present disclosure, do not require any additional steps or tools for leveling the mounting bracket on the mounting surface. In certain embodiments, additional leveling of the dispenser on the mounting bracket(s) may also not be required when the mounting brackets as disclosed are utilized.

Certain embodiments of the present disclosure include the following: (1) A dispenser mountable to a mounting surface, the dispenser comprising: a backplate adapted to be mounted to the surface, wherein the backplate comprises a first side and a second and opposite side, wherein the second side comprises a bracket engagement area; a cover enclosing at least a portion of said backplate when in a closed condition forming a housing having an interior volume so as to retain at least one dispensable product; and a circular mounting bracket having a faceplate containing one or more holes configured to receive a fastener for securing the mounting bracket to a wall, wherein the faceplate comprises at least one flange raised from a first surface of the faceplate, wherein the flange extends outward along the periphery of the faceplate, wherein the bracket engagement area comprises at least one latching means configured to engage the flange to secure the backplate to the mounting bracket.

(2) The dispenser of (1), wherein from about 220° to about 250° of the flange engages the latching means when the backplate is secured to the mounting bracket.

(3)The dispenser of (1), wherein the bracket engagement area comprises a recessed cavity on the second side of the backplate.

(4) The dispenser of (3), wherein the recessed cavity is conically-shaped to facilitate sliding the backplate over the mounting bracket to secure the backplate to the mounting bracket.

(5) The dispenser of (1), wherein the second side of the backplate is flush with the mounting surface when secured to the mounting bracket.

(6) The dispenser of (1), wherein the mounting bracket comprises a center hole for facilitating placement of the mounting bracket to the mounting surface.

(7) The dispenser of (1), wherein the first side of the backplate includes at least one fastener indicator, wherein the fastener indicator is positioned such that when a fastener is inserted into the fastener indicator the fastener further secures the backplate to the mounting bracket.

(8) The dispenser of (1), further comprising a dispensing mechanism contained within the housing for dispensing the dispensable product comprising a roll of sheet material.

(9) A dispenser as defined in (8), wherein the roll of sheet material comprises a roll of paper towels for dispensing paper towels from the dispenser.

(10) A dispenser as defined in (9), wherein the interior volume of the housing has a volume so as to retain at least two rolls of sheet material.

(11) The dispenser of (1), further comprising a dispensing mechanism contained within the housing for dispensing the dispensable product that is liquid.

(12) The dispenser of (1), wherein the one or more holes on the mounting bracket are configured in an anti-ligature pattern.

(13) The dispenser of (13), wherein the cover further comprises at least one push pin located along the margin of the cover, the push pin for separating the cover from the backplate when pressure is applied for facilitating disengagement of the cover from the backplate.

(14) The dispenser of (1), wherein the cover is hingedly attached to the backplate.

(15) A method for mounting a dispenser to a wall, comprising: placing a circular mounting bracket on a desired wall location, wherein the mounting bracket includes a faceplate comprising at least one flange raised from a first surface of the faceplate, wherein the flange extends outward along the periphery of the faceplate; securing the mounting bracket to the wall with one or more fasteners; securing the backplate of the dispenser on the mounting bracket by sliding a second side of the backplate having a bracket engagement area thereon including at least one latching means over the flange to secure the backplate to the mounting bracket, such that from about 220° to about 250° of the flange is engaged with the latching means when the backplate is secured to the mounting bracket.

(16) The method of (15), comprising marking the location of the mounting bracket on the wall utilizing a center hole located on the mounting bracket.

(17) The method of (15), comprising attaching a dispenser indicator to the mounting bracket to ensure correct placement of the mounting bracket on the wall.

(18) The method of (17), wherein the dispenser indicator includes a paperboard cutout corresponding to the dimensions of the backplate.

(19) The method of (15), wherein the method does not require any additional steps for leveling the mounting bracket or leveling the dispenser on the mounting bracket.

(20) The method of (15), wherein the mounting bracket includes a faceplate having one or more holes configured to receive a fastener for securing the mounting bracket to a wall, and optionally wherein the one or more holes are configured in an anti-ligature pattern.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A dispenser mountable to a mounting surface, the dispenser comprising:

a backplate adapted to be mounted to the surface, wherein the backplate comprises a first side and a second and opposite side, wherein the second side comprises a bracket engagement area;

a cover enclosing at least a portion of said backplate when in a closed condition forming a housing having an interior volume so as to retain at least one dispensable product; and a circular mounting bracket having a faceplate containing one or more holes configured to receive a fastener for securing the mounting bracket to a wall, wherein the faceplate comprises at least one flange raised from a first surface of the faceplate, wherein the flange extends outward along a periphery of the faceplate, wherein the bracket engagement area comprises at least one latching means configured to engage the flange to secure the backplate to the mounting bracket.

2. The dispenser of claim 1, wherein from about 220° to about 250° of the flange engages the latching means when the backplate is secured to the mounting bracket.

3. The dispenser of claim 1, wherein the bracket engagement area comprises a recessed cavity on the second side of the backplate.

4. The dispenser of claim 3, wherein the recessed cavity is conically-shaped to facilitate sliding the backplate over the mounting bracket to secure the backplate to the mounting bracket.

5. The dispenser of claim 1, wherein the second side of the backplate is flush with the mounting surface when secured to the mounting bracket.

6. The dispenser of claim 1, wherein the mounting bracket comprises a center hole for facilitating placement of the mounting bracket to the mounting surface.

7. The dispenser of claim 1, wherein the first side of the backplate includes at least one fastener indicator, wherein the fastener indicator is positioned such that when a fastener is inserted into the fastener indicator the fastener further secures the backplate to the mounting bracket.

8. The dispenser of claim 1, further comprising a dispensing mechanism contained within the housing for dispensing the dispensable product comprising a roll of sheet material.

9. The dispenser of claim 8, wherein the roll of sheet material comprises a roll of paper towels for dispensing paper towels from the dispenser.

10. The dispenser of claim 9, wherein the interior volume of the housing has a volume so as to retain at least two rolls of sheet material.

11. The dispenser of claim 1, further comprising a dispensing mechanism contained within the housing for dispensing the dispensable product that is liquid.

12. The dispenser of claim 1, wherein the one or more holes on the mounting bracket are configured in an anti-ligature pattern.

13. The dispenser of claim 12, wherein the cover further comprises at least one push pin located along a margin of the cover, the push pin for separating the cover from the backplate when pressure is applied for facilitating disengagement of the cover from the backplate.

14. The dispenser of claim 1, wherein the cover is hingedly attached to the backplate.

15. A method for mounting a dispenser to a wall, comprising: placing a circular mounting bracket on a desired wall location, wherein the mounting bracket includes a faceplate comprising at least one flange raised from a first surface of the faceplate, wherein the flange extends outward along a periphery of the faceplate; securing the mounting bracket to the wall with one or more fasteners; securing a backplate of the dispenser on the mounting bracket by sliding a second side of the backplate having a bracket engagement area thereon including at least one latching means over the flange to secure the backplate to the mounting bracket, such that from about 220° to about 250° of the flange is engaged with the latching means when the backplate is secured to the mounting bracket.

16. The method of claim 15, comprising marking the location of the mounting bracket on the wall utilizing a center hole located on the mounting bracket.

17. The method of claim 15, comprising attaching a dispenser indicator to the mounting bracket to ensure correct placement of the mounting bracket on the wall.

18. The method of claim 17, wherein the dispenser indicator includes a paperboard cutout corresponding to dimensions of the backplate.

19. The method of claim 15, wherein the method does not require any additional steps for leveling the mounting bracket or leveling the dispenser on the mounting bracket.

20. The method of claim 15, wherein the mounting bracket includes a faceplate having one or more holes configured to receive a fastener for securing the mounting bracket to a wall, and optionally wherein the one or more holes are configured in an anti-ligature pattern.

* * * * *